US005095183A

United States Patent [19]

Raphard et al.

[11] Patent Number: 5,095,183

[45] Date of Patent: Mar. 10, 1992

[54] GAS-BLAST ELECTRICAL CIRCUIT BREAKER

[75] Inventors: Denis Raphard, Sassenage; Maurice Perrin, St. Egreve; Laurent Besnard, St. Etienne de Crossey; Jean-Yves Blanc, Grenoble, all of France

[73] Assignee: Merlin Gerin, Meylan, France

[21] Appl. No.: 457,925

[22] Filed: Dec. 27, 1989

[30] Foreign Application Priority Data

Jan. 17, 1989 [FR] France ..... 89 00581

[51] Int. Cl.[5] ..... H01H 33/88

[52] U.S. Cl. ..... 200/148 A; 200/148 R

[58] Field of Search ..... 200/148 A, 148 R, 148 B

[56] References Cited

U.S. PATENT DOCUMENTS 3,988,554 10/1976 Graf et al. ..... 200/148 A

FOREIGN PATENT DOCUMENTS 0011542 5/1980 European Pat. Off. .

2438906 5/1980 France .

*Primary Examiner*—J. R. Scott

*Attorney, Agent, or Firm*—Parkhurst, Wendel & Rossi

[57] ABSTRACT

A pole-unit of a gas-blast electrical circuit breaker comprises a tranverse partition made of injected insulating plastic matérial which at the same time performs guiding of the movable contact which passes through it. The injected material part bears an O-ring ensuring tightness with the casing and a one-way check valve of gas flow orifices arranged in the transverse partition. The gas-blast piston securedly united to the movable contact is also made of injected material and it comprises housing and clipping means of the puffer nozzle securedly fixed to the piston. A scraper seal in the form of a split segment is housed in a circumferential groove arranged in the injected part of the piston. The electrical connection between the movable contact rod and a flexible current supply insert is achieved by a braided strip extending in the form of a half-loop in a transverse plane to the pole-unit.

10 Claims, 6 Drawing Sheets

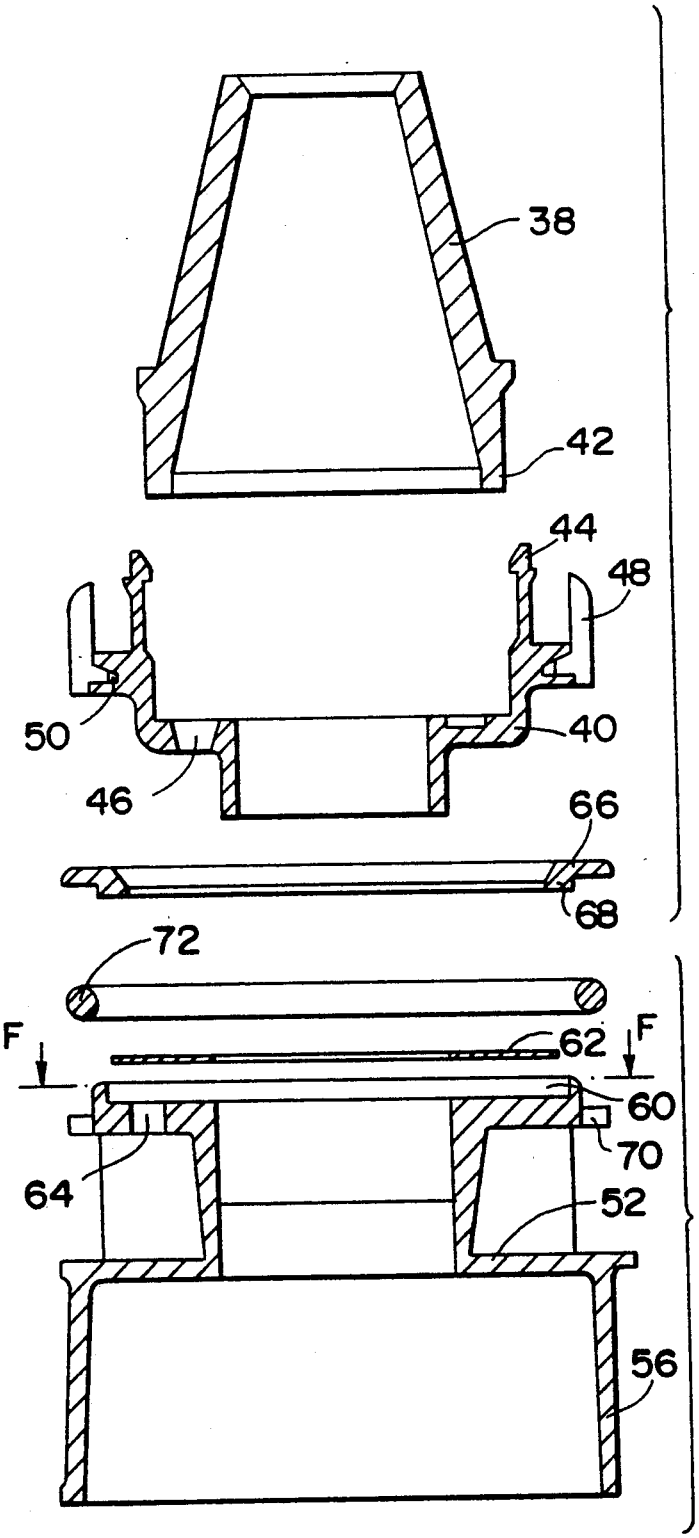
FIG. 4
FIG. 5
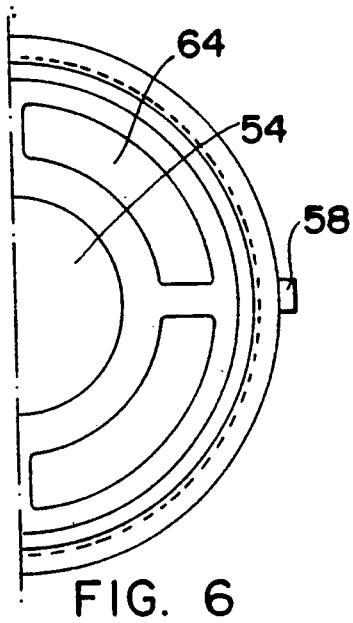
FIG. 6

GAS-BLAST ELECTRICAL CIRCUIT BREAKER

BACKGROUND OF THE INVENTION

The invention relates to a pole-unit of a medium voltage gas-blast circuit breaker by piston compression of a high dielectric strength gas, notably sulphur hexafluoride, comprising a sealed insulating casing of general cylindrical shape filled with the gas, in which a stationary contact and a movable contact are coaxially arranged, the latter being slidably mounted and bearing a piston, confining, with a transverse subdividing partition of said casing, a compressible volume compressing the puffer gas which blows out the arc drawn when separation of the contacts occurs.

A gas-blast electrical circuit breaker formed by assembly of several pole-units of the kind mentioned enables medium voltage currents to be broken by simple actuation of an operating shaft. Each pole-unit comprises an insulating molded enclosure in the form of a pocket sealed on its open end side by a metal or insulating cover. The structure and arrangement of these state-of-the-art pole-units are complicated and require a large assembly and manufacturing time. In particular, guiding the movable contact rod by a series of V-shaped groove rollers is complicated and costly.

The object of the invention is to achieve a pole-unit with a simplified structure using injected parts, secured by simply clipping them together.

SUMMARY OF THE INVENTION

The pole-unit according to the invention is characterized in that the transverse partition is formed by an insulating injected plastic material part fitted with small clearance and held in place in the casing, the part having a central orifice through which said movable contact passes, guided by the part, and gas flow orifices equipped with one-way valves, to enable the gas to enter the compressible volume freely through said partition, and to prevent the gas escaping from the volume in the opposite direction through the gas flow orifices.

The injected part constituting the transverse partition, which subdivides the casing into two chambers, comprises gas flow orifices open during the pole-unit closing phase, so as not to slow the moving assembly down in its closing movement. These orifices are closed off by an annular disk-shaped valve when the pole-unit opening phase takes place corresponding to compression of the blow-out gas in the compressible volume. The annular disk forming the valve is inserted with clearance between the injected part forming the partition and a retaining ring clipped onto this injected part. The tightness between the transverse partition and the pole-unit casing is provided by a seal, notably an 0-ring, arranged on the circumference of the injected part and secured by the retaining ring also cooperating with the valve disk. The injected part forming the transverse partition can be fitted in the pole-unit via the open end, its immobilization in rotation being performed by a pin sliding in a longitudinal groove arranged in the internal wall of the casing.

The positioning of the injected part in the longitudinal direction is achieved on the one hand by a cheek arranged on the internal wall of the casing, and on the other hand by a current input insert transversely sunk in the casing and bearing a connecting screw of a braided strip, which protrudes out towards the inside of the casing to act as the retaining stop of the injected part.

According to a development of the invention, the gas-blast piston securedly united to the movable contact is also made of injected plastic material and bears a puffer nozzle clipped onto the piston. A scraper segment in the form of a -split ring is inserted in a circumferential groove of the piston to ensure the tightness between the latter and the pole-unit casing.

The rigid part forming the intermediate partition performs guiding of the movable contact rod, and the current input to this contact rod is advantageously achieved by a braided strip. According to an important development of the invention, this braided strip extends in a transverse plane to the pole-unit being connected on the one hand to an insert forming a current bushing, sunk in the insulating casing, and on the other hand to the movable contact rod. The connection of the braided strip to the movable contact rod is performed at a point diametrically opposite to the fixing point of the braided strip to the current bushing. The braided strip preferably constitutes two current supply loops, symmetrically surrounding the movable contact in such a way as to limit the cross-section of the braided strip. The braided strip is preferably subdivided into different strands superposed in the axial direction of the pole-unit, in order to limit its rigidity in this direction. This arrangement of the braided strip in a transverse plane enables the height of the pole-unit to be reduced due to the limiting of the movement of this braided strip. The fixing screw of the braided strip to the lateral bushing at the same time performs the longitudinal positioning of the injected part forming the transverse partition. The fixing screw of the braided strip to the movable contact rod can at the same time provide the articulation of the connecting rod controlling the movement of the movable contact.

Eliminating the movable contact guiding and current supply rollers, and reducing the number of metal parts housed in the insulating casing, enable a better distribution of the fields to be achieved and the height of the pole-unit to be reduced.

BRIEF DESCRIPTION OF THE DRAWINGS

Other advantages and features will become more clearly apparent from the following description of several illustrative embodiments of the invention, given as non-restrictive examples only and represented in the accompanying drawings, in which:

FIG. 4 is a similar view to that of FIG. 2, showing the nozzle and piston before they are assembled;

FIG. 5 is a similar view to that of FIG. 3, showing the valve and sealing ring before they are assembled on the injected part;

FIG. 6 is a half-view according to the arrows F—F of FIG. 5;

DESCRIPTION OF THE PREFERRED EMBODIMENT

Figure 1:
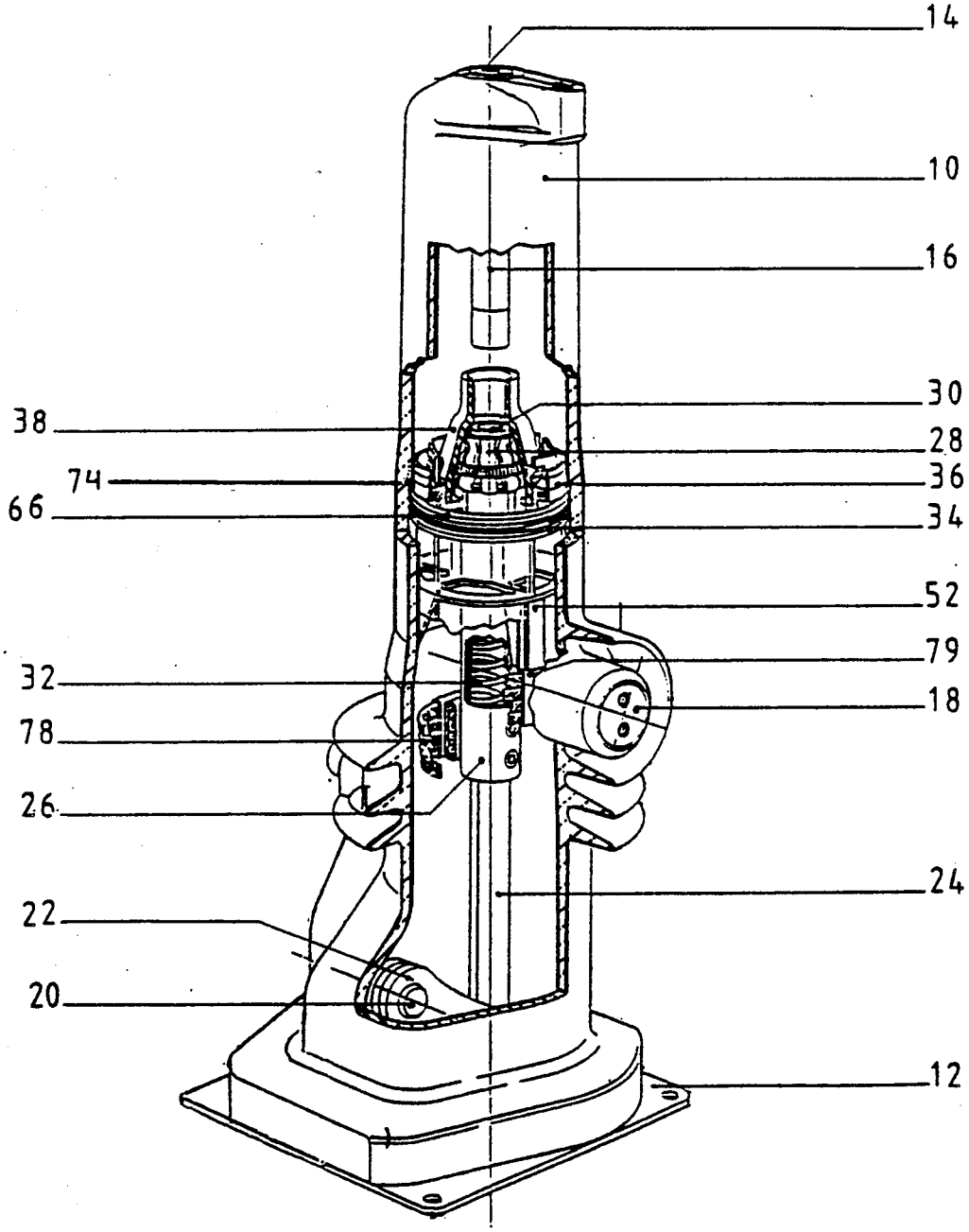
FIG. 1 is a partially cutaway schematic perspective view, showing a pole-unit according to the invention, represented in the open position.

In FIG. 1, a casing 10 of insulating material in the shape of a pocket is tightly sealed on its open end side by a plate 12. The enclosure confined by the casing 10 is filled with a high dielectric strength gas, notably sulphur hexafluoride, and two metal inserts are sunk in the wall of the generally cylindrical-shaped casing 10, one insert 14 passing through the base of the pocket constituting the casing 10 and being extended in the axial direction of the casing 10 by a tubular stationary contact 16. The other insert 18 extends transversely to the casing 10, being staggered on the cover 12 side. The two inserts 14, 18 constitute current bushings forming the input and output of the pole-unit housed in the casing 10. The casing 10 has passing through it an operating shaft 20 on which a racking-handle 22 is keyed controlling a connecting rod 24 articulated on a movable contact 26. The movable contact 26 bears at its end facing the stationary contact, tulip-finger main contacts 28, and a semi-stationary arcing contact 30 biased by a spring 32 to the protruding position of the tulip-finger main contacts 28. The movable contact 26 passes with small clearance through a transverse partition 34 subdividing the casing 10 into two chambers, one chamber for breaking the arc drawn when separation of the contacts 16, 30 occurs, and the other chamber for expansion of the breaking gases. The transverse partition 34 confines, with a piston 36 secured to the end of the movable contact 26, a compressible volume achieving, when a pole-unit opening movement occurs, compression of the gas and outflow of this gas from the compressible volume via a blast nozzle 38 fixed to the piston 36. Opening and closing of the pole-unit are controlled by rotation of the operating shaft 20 which brings about sliding of the movable assembly constituted by the movable contact 26 and the piston 36. A pole-unit of this kind is well-known to those specialized in the art and it is sufficient to recall that it does not require any external compressed arc blowing gas source, and enables maintenance-free operation for many years, notably without disassembly of the pole-unit.

Figure 2:
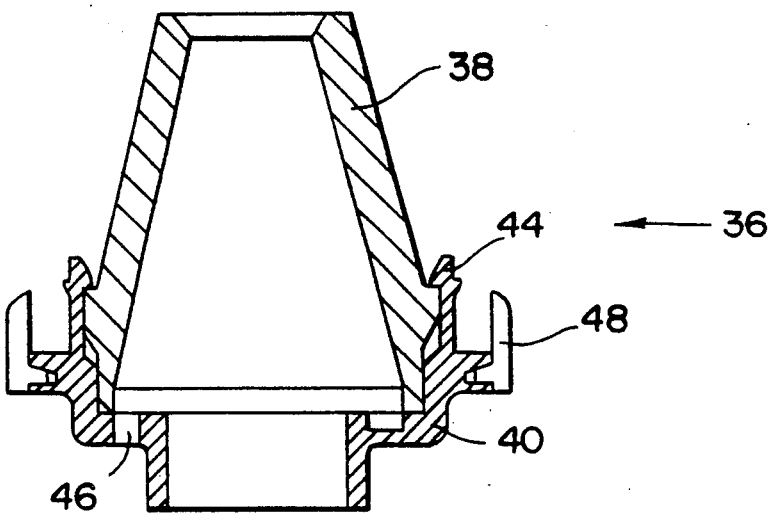
FIG. 2 is a sectional view of a gas-blast piston, bearing a nozzle, of the pole-unit according to FIG. 1.

Referring more particularly to FIGS. 2 and 4, it can be seen that the gas-blast piston 36 comprises an injected plastic material part 40 of a general circular shape, presenting on its upper face a cylindrical housing in which the base 42 of the nozzle 38 can engage. The nozzle 38 is assembled to the injected part 40 by simple clipping and it is held by retaining hooks 44 coming from injection with the part 40. The part 40 comprises orifices 46 via which the inside of the nozzle 38 and the opposite side of the piston 36 communicate. The tightness between the piston 36 and the casing 10 is ensured by a scraper seal 48 in the form of a split ring which comes and houses in a circumferential groove 50 of the injected part 40. Assembly of the piston 36 is particularly simple, as the scraper seal 48 merely has to be fitted and the nozzle 38 clipped into place. This ease of assembly is due to the possibility of producing suitably shaped parts by injection.

Figure 3:
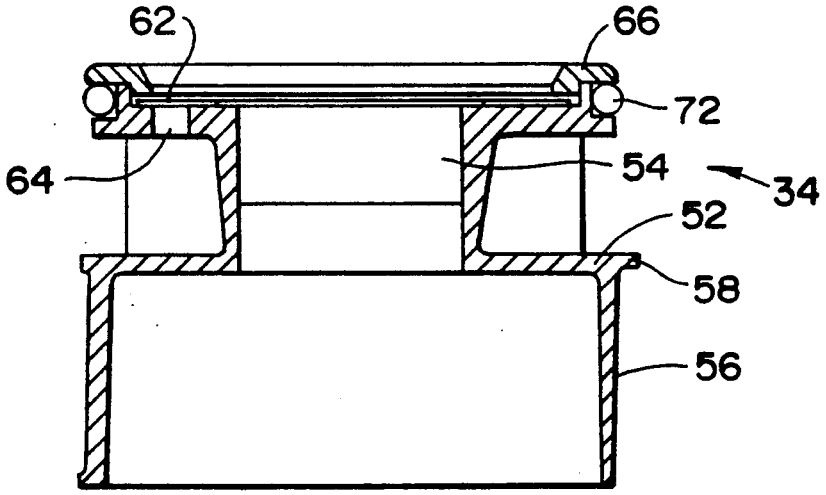
FIG. 3 is a sectional view on an enlarged scale of the injected part forming a transverse partition according to FIG. 1.

Referring more particularly to FIGS. 3, 5 and 6, the transverse partition 34 can be seen subdividing the casing 10 into two chambers. The transverse partition 34 is also formed by an injected plastic material part 52 of general cylindrical shape. The injected part 52 comprises a central part 54 forming a passing and guiding orifice of the movable contact 26 which passes through it. The orifice 54 extends over a certain axial height to ensure proper guiding of the movable contact 26. In its lower part, the injected part 52 is extended by a cylindrical skirt 56 following the outlines of the casing 10 with a small clearance to ensure perfect positioning of the transverse partition 34 in the casing 10. The positioning of this injected part 52 in rotation is obtained by the penetration of a laterally protruding pin 58, in a conjugate longitudinal groove (not shown) arranged in the internal wall of the casing 10. The upper part of the injected part 52 provides an internal circular housing 60 in which a disk-shaped valve 62 is fitted, capable of covering orifices 64 passing through the transverse partition 34. A retaining ring 66 can be fitted or possibly clipped into the housing 60 to hold the disk-shaped valve 62. The retaining ring 66 presents an external edge 68 which cooperates with a conjugate edge 70 of the injected part 52 to bound a circumferential groove housing an O-ring 72. The orifices 64 extend according to arcs of a circle to offer a notable gas flow cross-section while being capable of being sealed off by the disk-shaped valve 62 during the gas compression phase in the compressible volume.

Assembly and fitting of the transverse partition 34 are particularly simple, as the 0-ring 72 and the disk-shaped valve 62 merely have to be fitted before the retaining ring 66 is fitted. This assembly is then inserted in the casing 10 taking care to engage the laterally protruding pin 58 in the conjugate groove. At the end of engagement of the transverse partition 34, the upper edge of the retaining ring 66 comes up against a cheek 74 arranged in the internal wall of the casing 10. This cheek 74 limits the axial movement of the transverse partition 34 in the direction of the stationary contact 16. Movement in the opposite direction is limited by a plate 79 itself securedly fixed to a flexible braided strip 78 and held in place by a screw 76 screwed in the transverse insert 18. It can easily be seen that the cheek 74 and the plate 79 immobilize the transverse partition 34 in the axial direction, keeping the retaining ring 66 engaged in its housing 60. Immobilization of this transverse partition 34 in rotation is performed by the laterally protruding pin 58, and the axial height of the assembly ensures perfect positioning of the injected part 52 which ensures guiding of the sliding contact 26.

Figure 7:
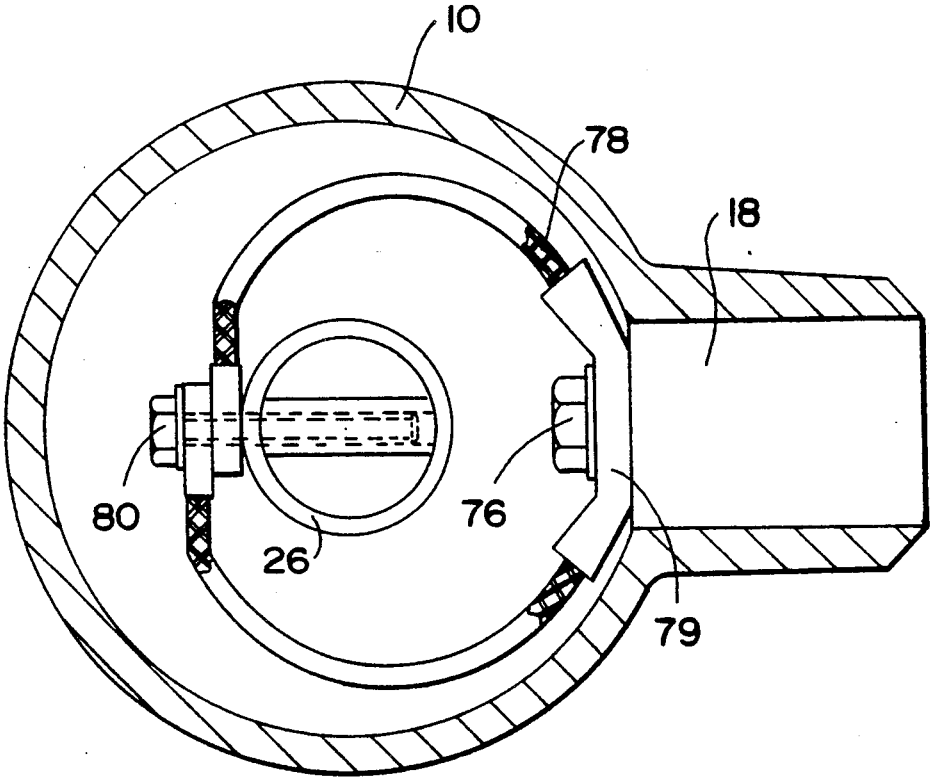
FIG. 7 is a transverse view of the pole-unit according to FIG. 1, at the lateral current bushing level.

The electrical connection between the movable contact 26 and the transverse insert 18 is provided by a flexible braided strip 78 extending in the form of two half-loops in a transverse plane to the casing 10 (FIG. 7). The two half-loops of the braided strip 78 surround the movable contact rod 26 on both sides, being securedly fixed by one of their ends to the metal insert 18 by a screw which is advantageously the axial positioning screw 76 of the transverse partition 34. The opposite end of the half-loops of the flexible braided strip 78 is connected to the movable contact 26 by a screw diametrically opposed to the axial positioning screw 76. The flexible braided strip 78 is sufficiently long to extend in proximity to the casing 10 over a sufficient length for axial movement of the movable contact 26. Referring more particularly to FIG. 1, it can be seen that the flexible braided strip 78 is made up of several strands superposed in the axial direction of the pole-unit to provide a certain flexibility in this axial direction. In the intermediate position of the movable contact rod 26, the flexible braided strip 78 extends appreciably in a diametral plane containing the insert 18, upwards and downwards movement occurring when sliding of the movable contact 26 takes place on either side of this diametral plane. In the extreme position, the flexible braided strip 78 extends in a slightly inclined plane, the length of this braided strip being sufficient to compensate for the increased distance between the axial positioning screw 76 and connecting screw 80. This transverse arrangement of the flexible braided strip 78 limits in height the space necessary to house the flexible braided strip 78, and enables the circuit breaker pole-unit to be shortened. The connecting screw 80 of the flexible braided strip 78 to the movable contact 26 advantageously constitutes the fixing and articulation spindle of the rod 24. A second screw can be superposed when a braided strip of relatively large height is used.

Fixing the piston 36 to the movable contact 26 can be accomplished in different ways, a particularly simple way consists of providing on the end of the movable contact 26 an edge onto which the injected part 40 is fitted. Keeping the parts fitted together can be easily achieved by fitting tulip-finger main contacts 28 which extend laterally beyond the movable contact 26 to overlap on the injected part 40. Any other fixing mode can of course be used.

The absence of any metal parts except for the one through which the current flows enables a better distribution of the field inside the pole-unit to be achieved and the dimensions of the latter to be reduced. The injected parts 40, 52 and possibly the scraper seal 48 and the stop ring 66, are for example made of a polycarbonate resin or of any other equivalent material, whereas the nozzle 38 is made of a fluorine polymer, for example polytetrafluorethylene. The casing 10 is preferably made in a known manner of epoxy resin.

Figure 8:
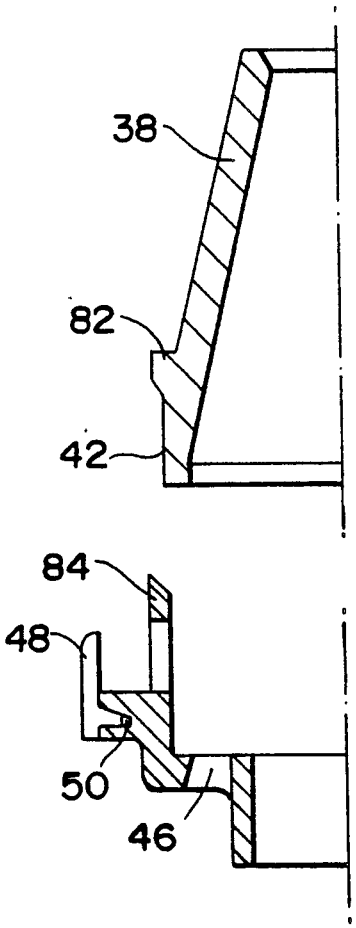
FIGS. 8 and 9 illustrate an alternative embodiment of the nozzle and of the piston, represented respectively before and after their assembly.
Figure 9:
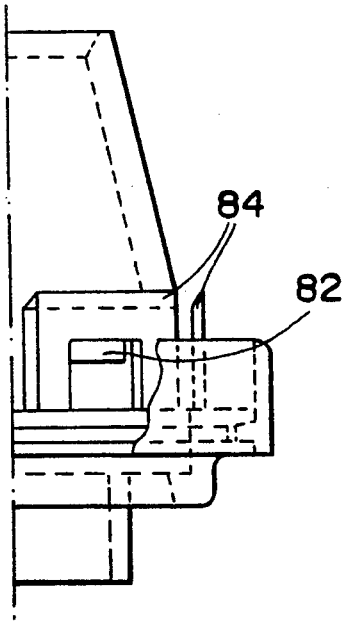

FIGS. 8 and 9 illustrate an alternative embodiment of the fixing by clipping the nozzle 38 onto the injected part 40. The nozzle 38 has teeth 82 which clip onto bracket-shaped lugs 84 borne by the injected part 40.

Figure 10:
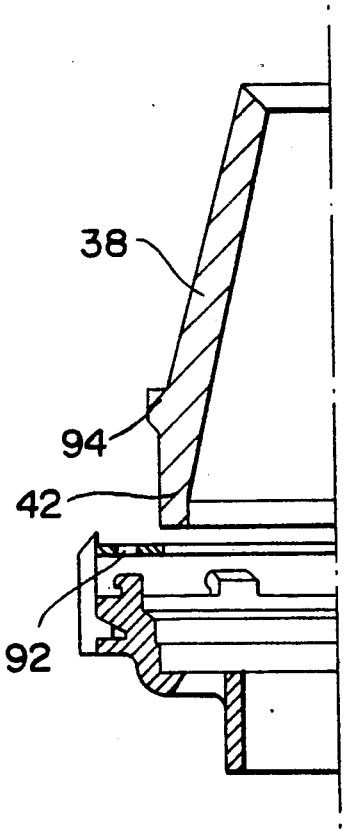
FIGS. 10 and 11 are similar views to FIGS. 8 and 9 showing another alternative embodiment.
Figure 11:
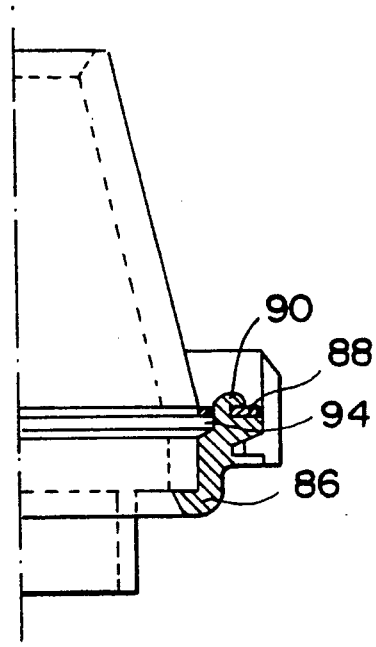
Figure 12:
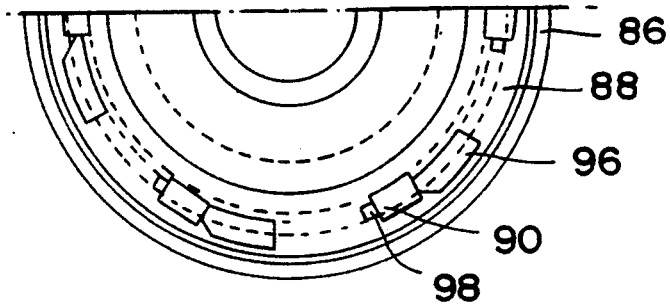
FIG. 12 is a plane half-view of the nozzle-piston assembly according to FIG. 11.

Other fixing modes are conceivable and FIGS. 10 to 12 show fixing by means of a ring 88. The nozzle 38 bears a circumferential collar 94 in the proximity of its base 42 and the injected part 40 has fixing catches 90 on which the ring 88, which bears against the collar 94, engages and is fixed. The ring 88 comprises facing each catch 90, a bayonet orifice 98 whose widened part 96 enables the ring to be fitted onto the catch 90 and whose narrow part is bayonet orifice 98 which enables by pivoting to pass onto the catch 90 and the ring 88 and the nozzle 38, attachment to the injected part 40.

We claim:

1. A pole-unit for a medium voltage gas-blast circuit breaker using piston compression of a high dielectric strength gas comprising:

a sealed insulating casing of general cylindrical shape filled with said gas, said casing having a stationary contact and a movable contact coaxially arranged therein, said movable contact being mounted to slide in and out of contact with said fixed contact;

a piston supported by said movable contact; and a transverse subdividing partition comprising an insulating injected plastic material part tightly fitted within and held in place in said casing, said plastic material part having a central orifice through which said movable contact passes, guided by said plastic material part, and peripheral gas flow orifices equipped with one-way valve means, said peripheral gas flow orifices being located adjacent to said central orifice, said transverse subdividing partition confining with the piston a compressible volume, wherein a puffer gas is compressed to blow out an arc drawn when separation of said movable contact and said fixed contact occurs, said one-way valve means enabling entry of gas into the compressible volume freely through said transverse subdividing partition while simultaneously preventing the gas from escaping the compressible volume in a direction opposite of that entry.

2. The pole-unit of claim 1, wherein said gas flow orifices are open and closed by said one-way valve means by action of pressure from the compressible volume, said one-way valve means being in the shape of an annular disk.

3. The pole-unit of claim 2, further comprising a retaining means connected to said plastic material part, wherein said annular disk is inserted to maintain clearance between said plastic material part and said retaining means.

4. The pole-unit of claim 3, further comprising a seal between said transverse subdividing partition and said casing, said seal being arranged on a circumferential portion of said plastic material part and held in place by said retaining means.

5. The pole-unit of claim 1, wherein said plastic material part further comprises a lateral protruding pin and said casing further comprises a conjugate groove arranged longitudinally in an internal wall thereof, engagement of said pin in said groove resulting in said partition being fastened inside said casing.

6. The pole-unit of claim 1, wherein said casing further comprises an insert which forms a lateral current bushing, and a contracted edge, and said plastic material part is positioned in said casing between said contracted edge and said bushing.

7. The pole-unit of claim 1, wherein said piston is made of injected plastic material, and further comprises a guide nozzle fixed thereto.

8. The pole-unit of claim 7, wherein said piston bears a scraper segment displaced circumferentially about said piston and in slidable contact with said casing so as to produce a seal between said piston and said casing adequate to substantially reduce air flow therethrough.

9. The pole-unit of claim 1, further comprising a lateral bushing formed on said casing and a current supply braided strip having a first connection to said movable contact and a second connection to said lateral bushing, said strip extending appreciably in a transverse plane of the casing.

10. The pole-unit of claim 9, wherein in a middle position of said movable contact, said braided strip extends essentially in a diametral plane of the casing containing said bushing and wherein said braided strip is fixed to said movable contact at a point diametrically opposite said bushing.

* * * * *